US005588708A

United States Patent [19]

Rykken et al.

[11] Patent Number: 5,588,708

[45] Date of Patent: Dec. 31, 1996

[54] ARRANGEMENT IN A FURNITURE MEMBER, ESPECIALLY A LEG SUPPORTING MEMBER FOR A CHAIR

[76] Inventors: Arne O. Rykken, Øystese, 5610 Øystese, Norway; Søren Meinert, Bagergade 37, 5700 Svendborg, Denmark

[21] Appl. No.: 416,866

[22] PCT Filed: Oct. 18, 1993

[86] PCT No.: PCT/NO93/00154

§ 371 Date: Apr. 19, 1995

§ 102(e) Date: Apr. 19, 1995

[87] PCT Pub. No.: WO94/08494

PCT Pub. Date: Apr. 28, 1994

[30] Foreign Application Priority Data

Oct. 19, 1992 [NO] Norway ..... 924044

[51] Int. Cl.[6] ..... A47C 7/50

[52] U.S. Cl. ..... 297/423.2; 297/284.11; 297/463.1

[58] Field of Search ..... 297/463.1, 284.1, 297/284.2, 284.4, 423.1, 423.2, 423.19, 423.22

[56] References Cited

U.S. PATENT DOCUMENTS 155,187 9/1874 Enger ..... 297/423.27

3,007,738 11/1961 Gardel et al. ..... 297/423.2

FOREIGN PATENT DOCUMENTS 435495 9/1935 United Kingdom ..... 297/423.2

*Primary Examiner*—Milton Nelson, Jr.

*Attorney, Agent, or Firm*—Burns, Doane, Swecker & Mathis, LLP

[57] ABSTRACT

The present invention relates to an arrangement in a calf-supporting part (5) for a chair (1) comprising a chair seat part (4) anda back part (3), the calf-supporting part (5) comprising a web-shaped portion (5) supported by means of moveable supporting/carrying devices (6) and moving in a loop (**4*b*) through one or several curved guides (22) which are attached to the supporting/carrying devices (6) so that the web-shaped portion (5) may be pushed continuously between a shielded, inactive retracted position beneath the chair seat part (4) and an active protruding calf-supporting position chiefly flush with the chair seat part, and for the purpose of acquiring a calf-supporting part which comprises uncomplicated parts and is adjustable in a readily controllable but effortless manner it has been suggested according to the invention that the supporting/carrying devices should comprise a single slim sheet-shaped device (6), being separated physically from the web-shaped portion (2). This entails that the web-shaped portion may be made up of a chiefly separate cover-material, i.e. of a material, man-made or cloth-like structure, constituting the same cover material or readily adaptable to the cover material of the chair seat part (4**).

23 Claims, 11 Drawing Sheets

10a
11a
13a
12
13b
10b
11b
6
16a
16b
10'a
11'a
13'a
12'
13'b
10'b
11'b
17
14
6'
17'
14'

ARRANGEMENT IN A FURNITURE MEMBER, ESPECIALLY A LEG SUPPORTING MEMBER FOR A CHAIR

An arrangement in a calf-supporting part for a piece of furniture or such like, particularly a chair, including a chair seat part and a back rest part, the calf-supporting part including a web-shaped portion which is given support by moveable supporting/carrying devices and runs in a loop through one or several curved guides attached to the supporting/carrying devices, so that the web-shaped portion may be pushed continuously between a shielded, inactive retracted position beneath the chair seat portion and an active protruding calf-supporting position, chiefly flush with the chair seat part.

PRIOR ART

From NO patent specification 162.994 a chair arrangement is known of the nature stated above, a calf-supporting part having been made of an upholstered web-shaped portion, stiffened in its traverse direction, the said web-shaped portion consisting of a base of traversing stays, comparatively rigid in their lengthwise direction and sideways interlinking. Above the said stays, upholstery is arranged, and also a web-shaped cover material, preferably a cover material matching the cover of the chair as such.

The background to the present invention is in the task of showing an improved arrangement in a calf-supporting part in which there is no need to rely on linked rigid stays for stiffening the upholstered web-shaped portion, such interlinking, rigid stays being complicated and costly to make while at the same time the rigidity of the stays causes the rolling function to be slow-moving.

A further task of the present invention is in describing an arrangement which not only avoids the use of interlinking rigid stays but may also be manufactured from uncomplicated components, while at the same time the transition of the calf-support from its passive to its active position and vice versa may be performed with the use of comparatively little effort.

DESCRIPTION OF THE INVENTION

The aims outlined above will be achieved with an arrangement of the nature mentioned initially, which is, according to the present invention characterised by the supporting/carrying devices comprising one single slim sheet-shaped device segregated physically from the web-shaped portion.

Because this physical segregation is achieved between the actual supporting/carrying devices and the web-shaped portion, the web-shaped portion may chiefly in itself comprise a separate cover material, i.e. a material or man-made or cloth-like structure constituting the same cover material or readily adaptable to the cover material of the piece of furniture, specifically the chair seat.

Preferably, the sheet-shaped supporting/carrying device is at either side of its rear part fitted with a smooth wheel and a toothed wheel. Preferably then each of the toothed wheels on the sheet-shaped supporting/carrying device will interact with a corresponding toothed track or toothed guide each arranged in a groove positioned at the side and fastened to the underside of the chair seat or to other parts of the chair or the piece of furniture.

At its forward part, the sheet-shaped supporting/carrying device may then have been made with a guide designed as a smooth sliding roller, which runs traversely and can be turned freely.

At the rear area of the sheet-shaped supporting/carrying device a transverse turning axle is arranged, carrying at either end one each of the said toothed wheels, in order thereby to turn in step with these while at the same time at least one band-like guiding device has been wound round the said turning axle.

The said band-like guiding device is at its one end fixed permanently to a frame part, chiefly arranged at a lower forward part of the chair seat part, in which area also one stationary traversing edge of the web-shaped portion has been attached, the band-like guiding device at its other end being fixed to the opposite moveable traversing edge of the web-shaped portion.

From a retracted passive position below or behind the relevant part of the chair, in particular the chair seat part, the calf-supporting part may thereby be pushed forward, namely by the sheet-shaped supporting/carrying device being pushed forward, e.g. by means of a handle arranged at the forward smooth sliding roller. This sliding roller will then, being in contact with the underside of the web-shaped portion, push the said web-shaped portion ahead while at the same time the proportions of the web-shaped portion pushed out will make contact with the slim sheet-shaped supporting/carrying device.

The movable traverse edge of the web-shaped portion is held taughtly in place below the sheet-shaped supporting/carrying device by means of the said band-like guiding device both when being parked underneath the chair seat part, while the supporting/carrying device is being pushed out, and even when in particular the calf-support is fully extended in its calf-supporting position.

It should be understood that the present invention has been developed especially in connection with a calf-supporting part for a chair, but the present supporting/carrying device may also find a use in connection with chair backs to possibly adjust the height and the shape of the chair back, and in particular together with an adjustable calf-support. Such an adjustment of both back and seat will entail that the chair may be adapted to the body size of individual users, and their purpose of use, which could be appropriate for chairs in the home, on trains, in aircraft, as well as in other means of transport and installations.

It should further be understood that the present arrangement may also find a use in connection with furniture other than chairs, e.g. beds, which may have their width, length or resting area extended in a simple and energy-conserving manner. The device may e.g. be executed as an attachment to a sofa-bed, or as a sideflap to a hospital bed.

Additional features and advantages will be seen from the description below, taken in conjuncture with the attached drawings.

BRIEF DESCRIPTION OF FIGURES IN THE DRAWINGS

DETAILED DESCRIPTION OF EMBODIMENTS

Figure 1:
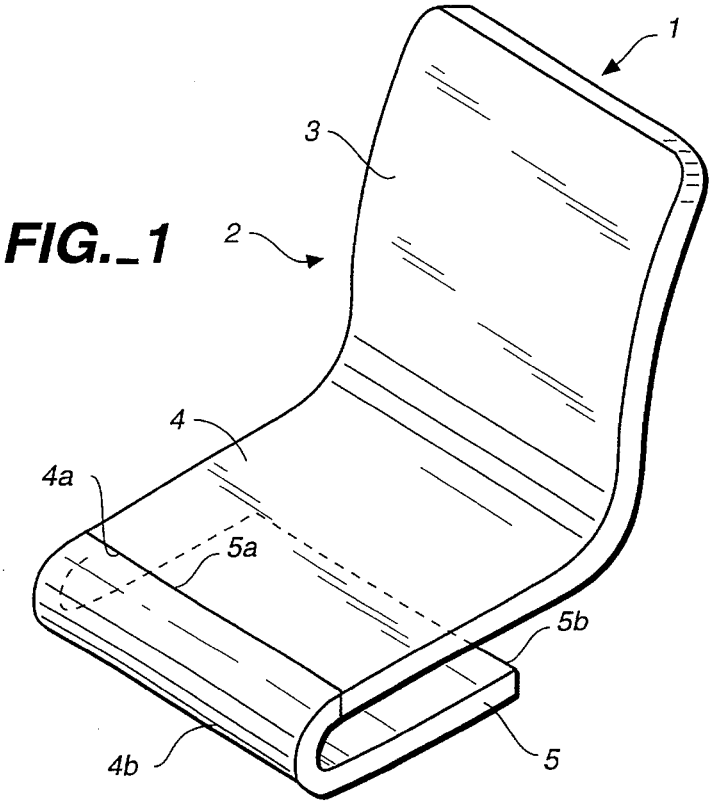
FIG. 1 is a schematic outline perspective of a calf-supporting part for a chair comprising a chair seat part and a back part, the calf-supporting part being shown here in its retracted position below the chair seat part.
Figure 2:
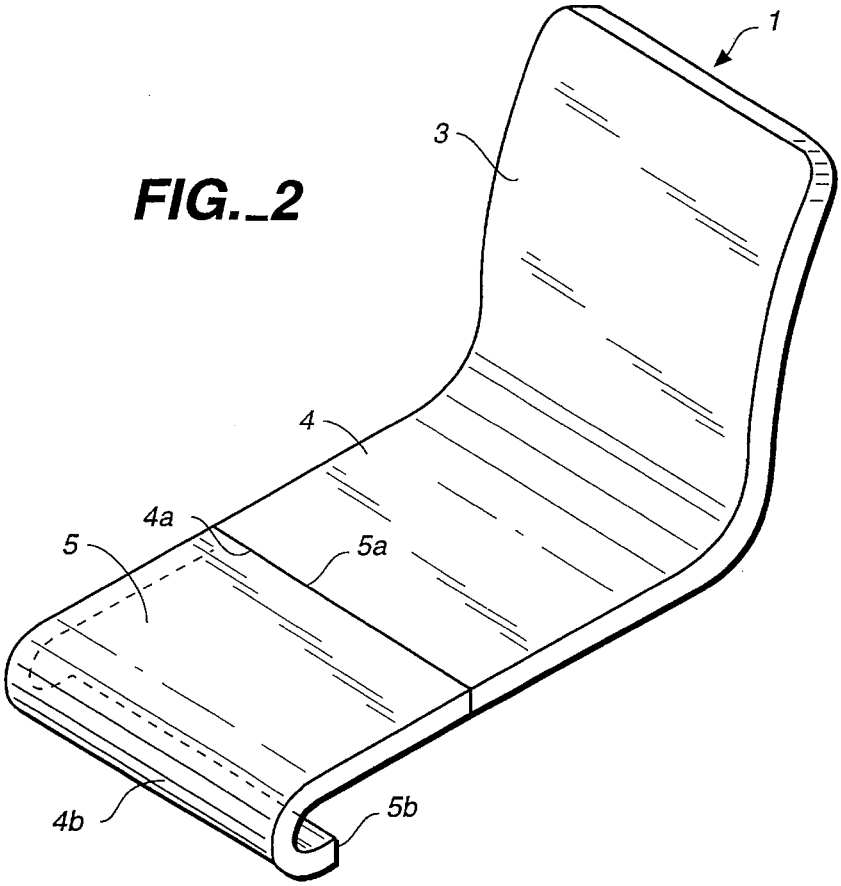
FIG. 2 is a schematic outline perspective like FIG. 1, showing the calf-support in its protruding calf-supporting position in front of the chair seat part.
Figure 3:
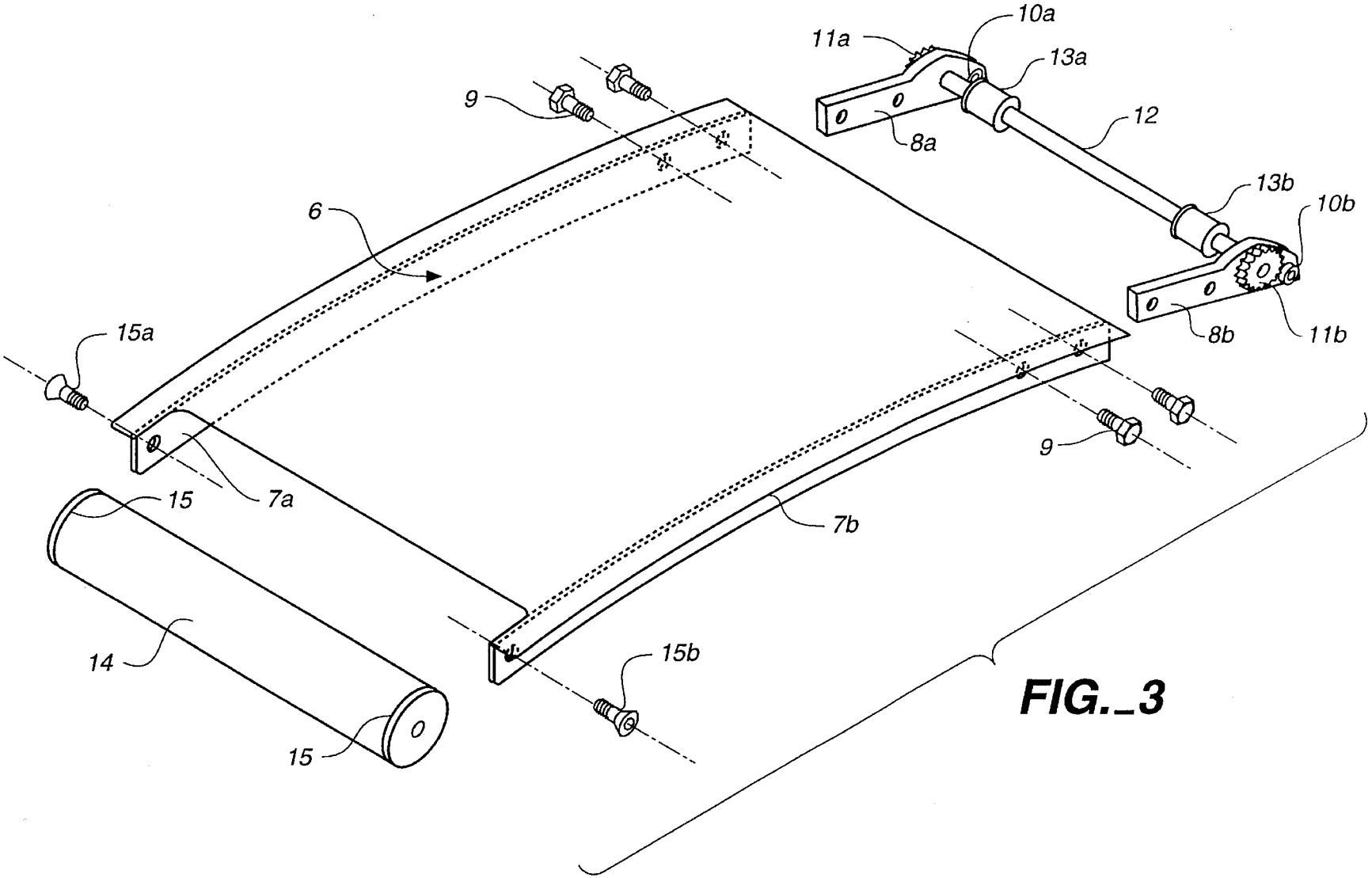
FIG. 3 is a schematic blown-up outline perspective of an embodiment of a supporting/carrying device according to the present invention.
Figure 4:
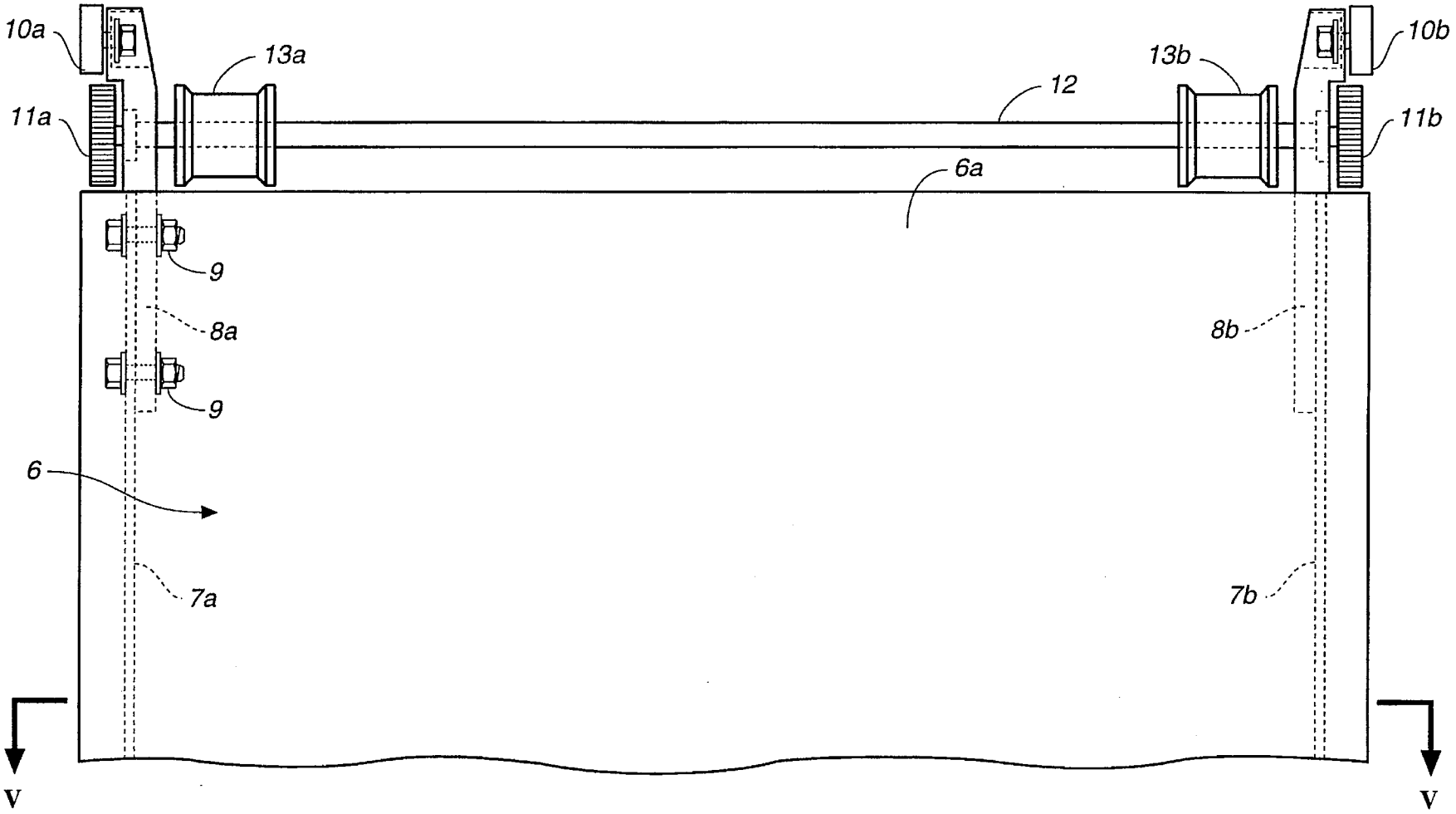
FIG. 4 is a cut-out of an outline viewed from above of a corresponding embodiment for the supporting/carrying device according to the present invention.

Shown in outline in FIGS. 1 and 2 is a chair upper of a chair generally defined by the reference numeral 1.

The chair 1 is covered in a web-shaped material 2, the said material covering a chair back part 3 and a chair seat part 4. The chair 1 also comprises a calf-supporting part defined here by the reference numeral 5 which may be pushed continuously between a shielded inactive retracted position underneath the chair seat part 4, as is evident from figure 1, and an active protruding calf-supporting position, chiefly flush with the chair seat part 4, as will be evident from FIG. 2.

It should be understood that the chair 1 may also be executed with a corresponding back supporting part which may be pushed continuously up and down flush with the chair back part 3 of the chair.

The calf-supporting part 5 comprises a main part which is chiefly in the form of a web-shaped portion running from its forward edge 4*a* of the chair seat part 4, in a loop 4*b* through suitable curved guides which will be mentioned later and are attached to suitable supporting/carrying devices also to be mentioned later. The web-shaped portion 5 is of a length corresponding approximately to the fully protracted calf-supporting part as is evident from figure 2, and thus stretches from a forward traversing edge 5*a* arranged by or incorporated in the forward portion 4*a* of the chair seat part 4, to a rear traversing edge 5*b*.

Shown in FIGS. 3–7 is a particular embodiment for the moveable supporting/carrying devices which support the web-shaped portion 5 mentioned above, and also comprising suitable guiding devices.

Thus, the said supporting/carrying devices of the embodiment shown in FIGS. 3–7 are executed as one single slim sheet-shaped device 6, capable, because of its expanse lengthwise and across, of supporting the web-shaped portion 5 shown in FIGS. 1 and 2 without being an integrated part of the web-shaped portion. In other words, the sheet-shaped portion 6 may be fashioned physically separate from the said web-shaped portion 5 which entails a number of advantages which will be mentioned below.

Firstly, the web-shaped portion, because of the sheet-shaped supporting/carrying device may be executed chiefly as a separate cover material, i.e. of a material, man-made or cloth-like structure which makes up the same cover material or is readily adaptable both to the cover material of the chair seat part 4 and the cover of the back part 3.

Figure 5:
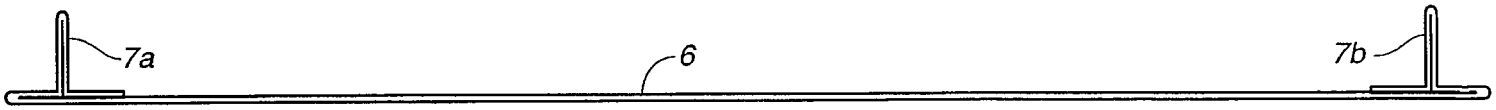
FIG. 5 is a section along the line V—V of FIG. 4.
Figure 6:
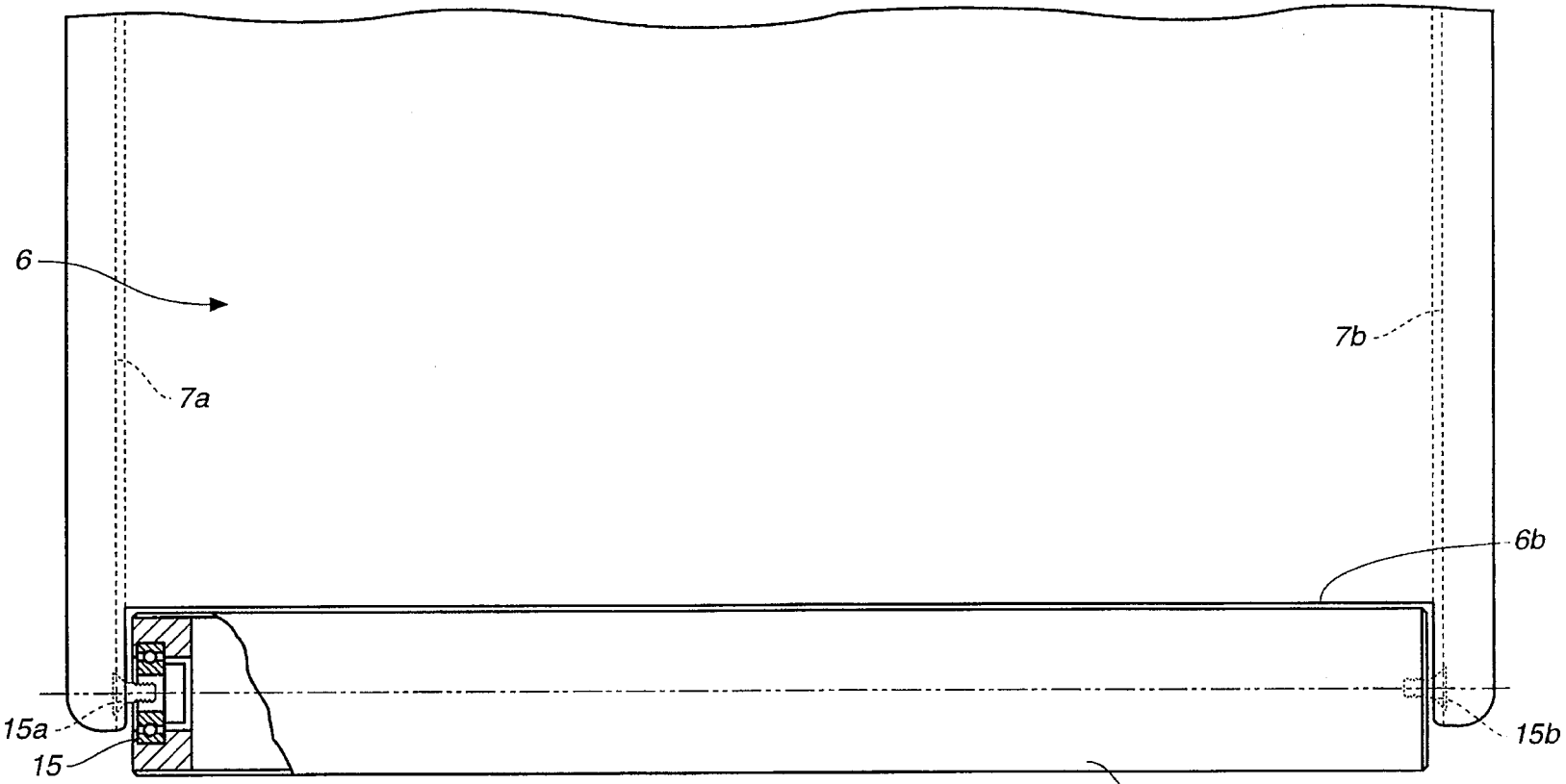
FIG. 6 is a supplementary cut-out of the outline shown in FIG. 4, showing an embodiment for a supporting/carrying device according to the invention.
Figure 7A:
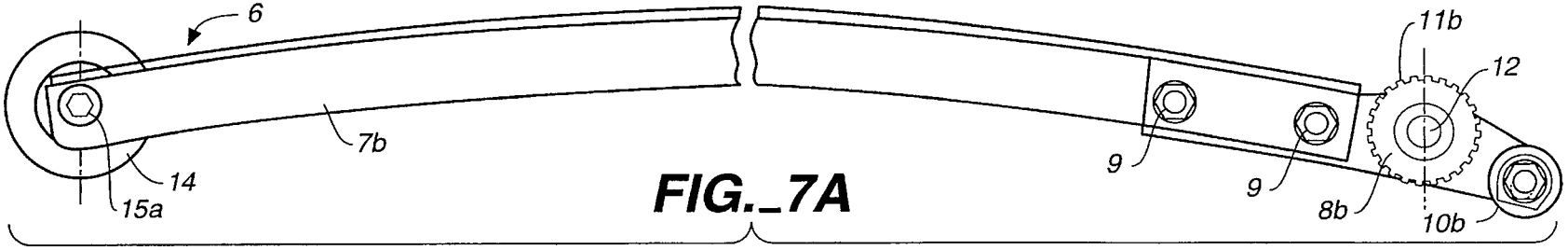
FIG. 7 is a sideways outline of the embodiment for a supporting/carrying device shown in FIGS. 4–6.
Figure 7B:
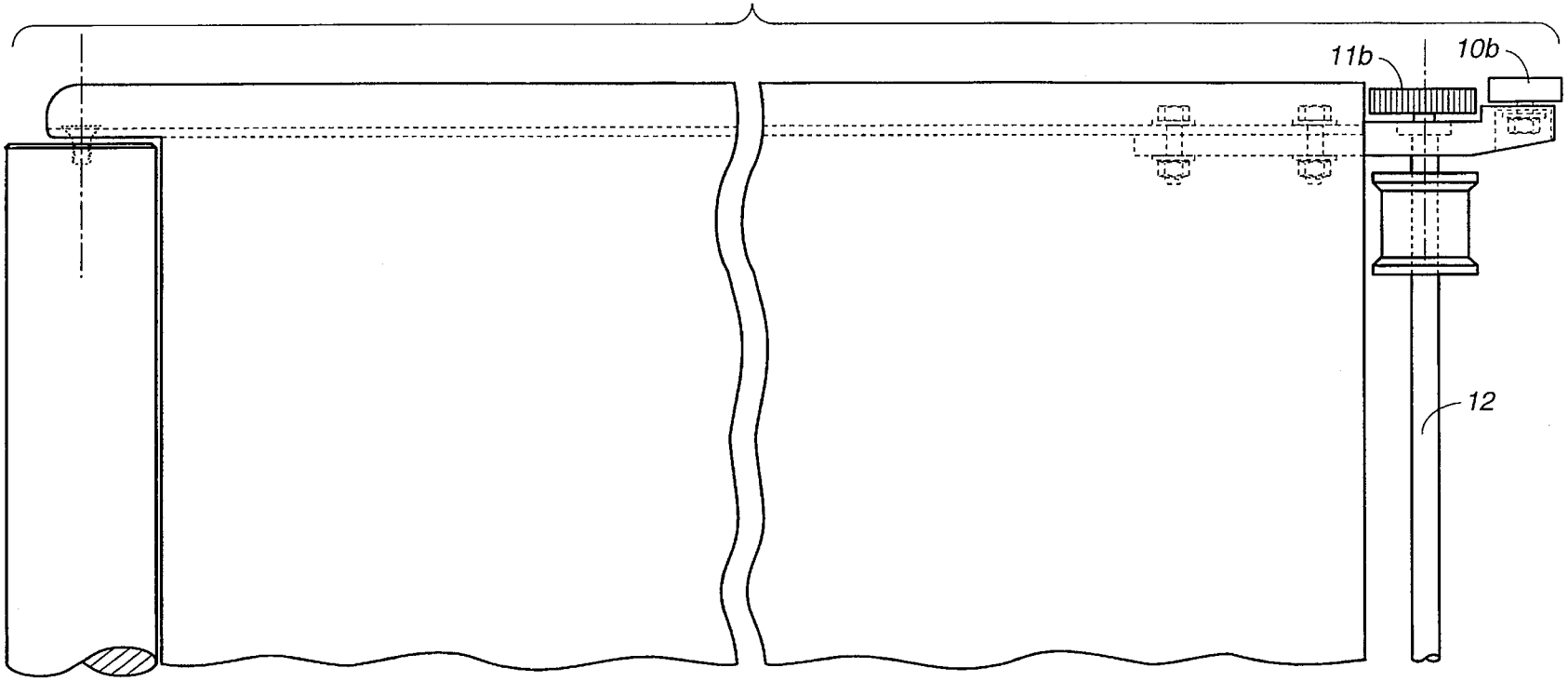

The sheet-shaped supporting/carrying device 6 is as shown in FIG. 5 made with longitudinal ribs 7*a* and 7*b*, and at the rear portion 6*a* of the sheet-shaped supporting/carrying device 6, a bracket 8*a* and 8*b*, respectively, is screwed into the said ribs, preferably by means of suitable screw and bolt connections 9. A portion of the said brackets, 8*a*, 8*b*, protrude over the rear portion 6*a* of the supporting/carrying device 6 in order there to carry a smooth wheel, 10*a* and 10*b*, respectively, and a toothed wheel, 11*a* and 11*b*, respectively. Between the said toothed wheels, 11*a* and 11*b* a traversing rotating axle extends which turns together with the said toothed wheels, while at the same time two guide reels, 13*a* and 13*b*, respectively, are arranged on the axle. These guide reels 13*a* and 13*b* may turn more or less freely on the said axle 12, but with a suitable small play, and the said guiding reels 13*a* and 13*b* serve to guide one each of the band-like guiding devices which will be mentioned in further detail below.

At its forward portion 6*b* on the ribs 7*a*, 7*b* a guiding device is arranged, designed as a chiefly smooth sliding roller 14, freely rotatable and running transversely, suitably held by roller bearings 15 which are in turn suitably fixed by means of screws 15*a*, 15*b*.

Shown in FIGS. 8–12 is how the sheet-shaped supporting/carrying device 6 mentioned above may be mounted into suitable guide rails or profiles which may be attached to the underside of the chair seat part 4, or some other suitable stationary part of the chair frame.

Figure 12A:
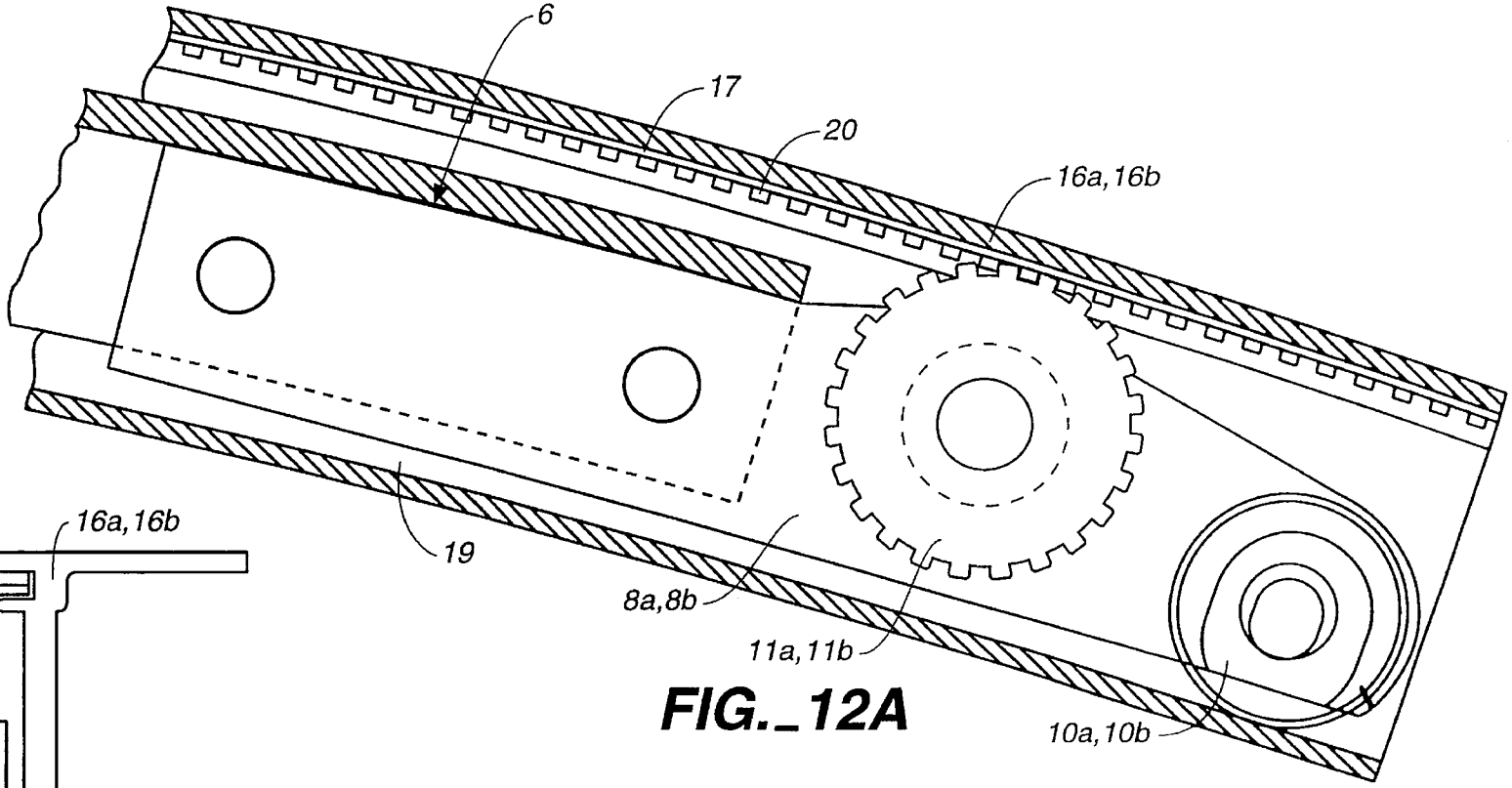
FIG. 12 shows schematically details of the embodiment in grooves or profiles of the supporting/carrying device according to the invention.
Figure 12B:
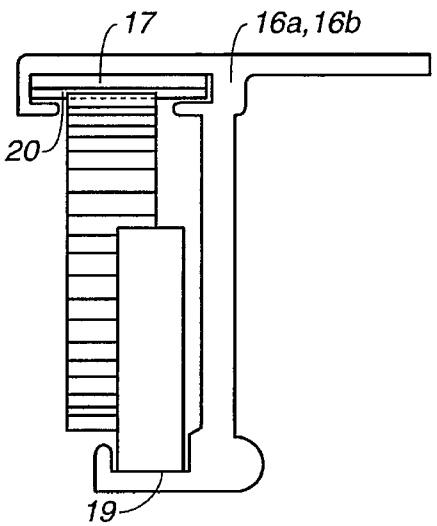

Shown in the said figures are thus two sideways positioned grooves, 16*a* and 16*b*, respectively, the cut-out of these grooves 16*a* and 16*b* being shown to a larger scale in figure 12. As will be seen from the latter FIG. 12, in each of the grooves a toothed track or toothed guide 17 has been arranged in which the said toothed wheels 11*a*, 11*b* engage while at the same time the pertaining smooth wheel, 10*a* and 10*b*, respectively will make contact with a groove portion 19 which is opposite to the groove portion 20 carrying the respective toothed tracks or guides 17.

Figure 8:
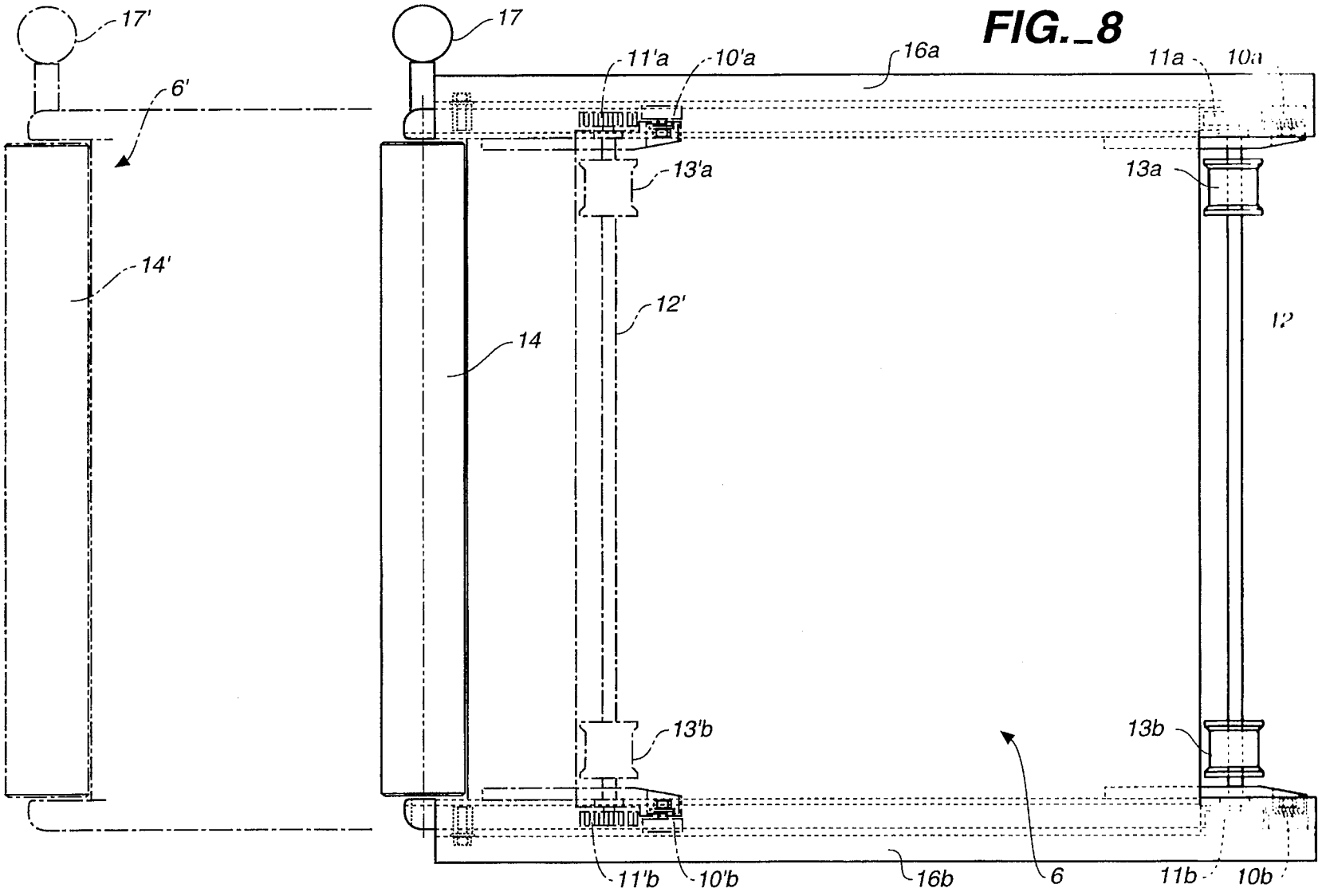
FIG. 8 is an outline viewed from above of an embodiment for a supporting/carrying device according to the invention, fitted into grooves or profiles placed at the sides, the fully drawn line showing the supporting/carrying device when the calf-support is retracted, while the broken lines show the device in its protruding calf-supporting position.

Shown in FIG. 8 is an outline viewed from above of the previously mentioned supporting/carrying device 6 when mounted into the sideways positioned grooves 16*a*, 16*b*, the fully drawn line showing the supporting/carrying device 6 with the calf-support retracted, while the broken line shows how the supporting/carrying device 6' with its forward smooth sliding roller 14' and its traversing axle 12' with its toothed wheels, 11'a and 11'b, respectively, and smooth wheels, 10'a and 10'b, respectively, and the guide reels 13'a and 13'b, has been pushed left in the figure, namely along and partly out of the stationary grooves 16a, 16b.

Because of the interrelationship between the toothed wheels 11a, 11b and the smooth wheels 10a, 10b, please see in particular FIG. 12, the sheet-shaped supporting/carrying device 6 can be moved between a retracted position under the chair seat part 4 and to a protruding calf-supporting position in an effortless yet well controlled manner. It should be understood that moving the sheet-shaped supporting/carrying device 6 back and forward may be done by means of a knob 18 fitted and protruding from the side in line with the center axis of the said smooth sliding roller 14, please see FIG. 8.

Figure 9:
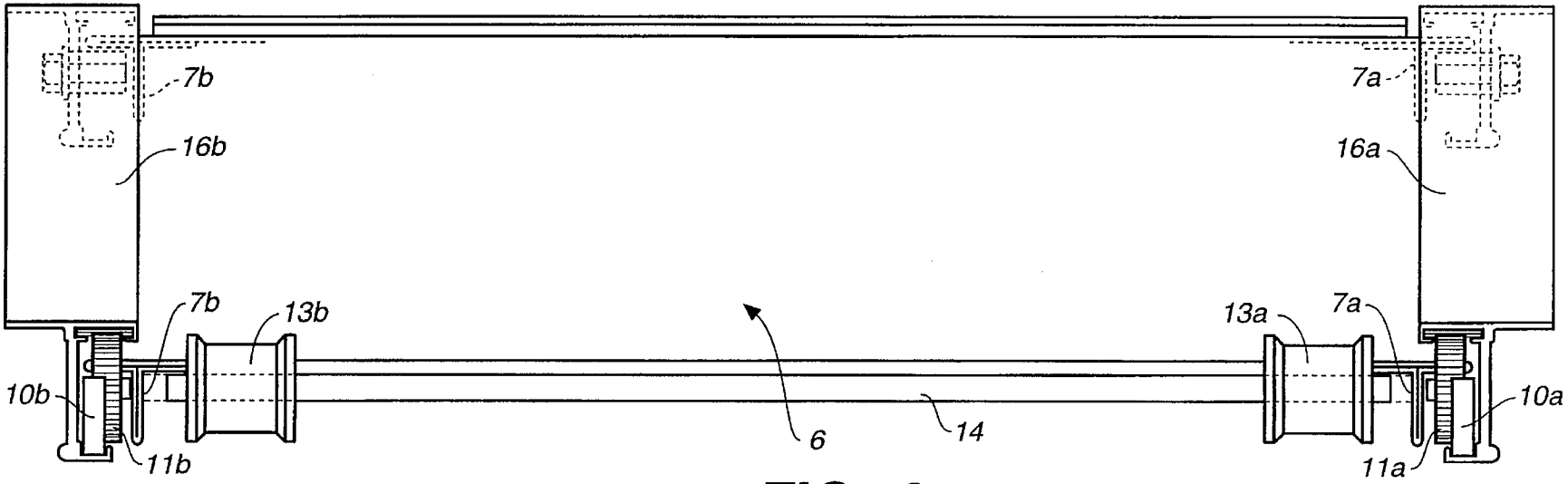
FIG. 9 is an end-on outline of the embodiment shown in FIG. 8.
Figure 10:
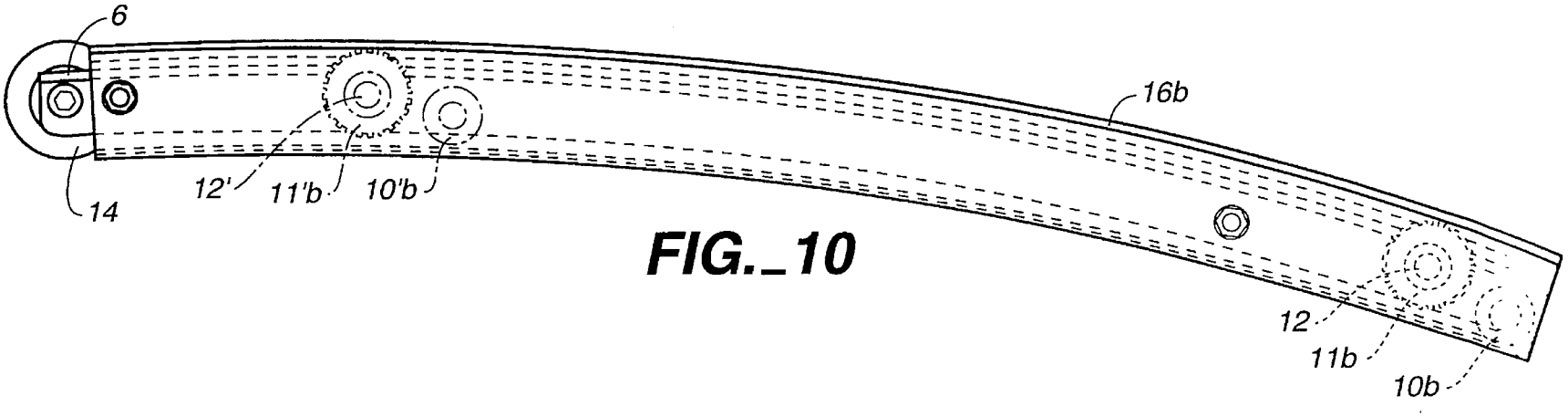
FIG. 10 is a sideways outline of the embodiment shown in FIG. 8, with some components shown when the supporting/carrying device is in its retracted and its protracted position, respectively.
Figure 11:
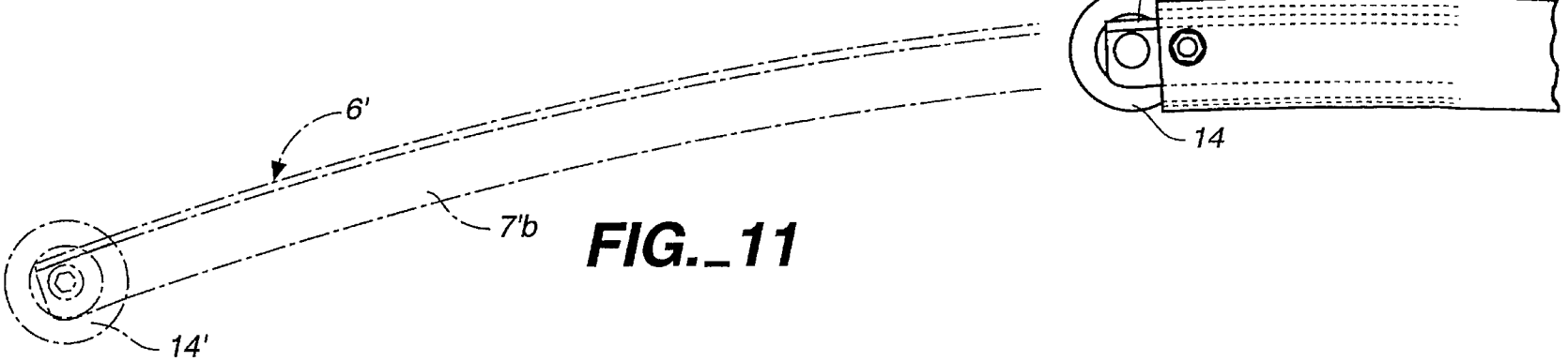
FIG. 11 illustrates some components of the supporting/carrying device in its protruding position.

From FIGS. 9, 10, 11 it is evident that the grooves 16a and 16b are fashioned as curves which entails that also the sheet-shaped device 6 is of a corresponding shape, curved in its lengthwise direction. It should, however, be understood that the curvature which may be given to the sheet-shaped device 6 as well as the grooves 16a and 16b, may vary within wide limits, since this may be adapted to the relevant design of the actual calf-supporting part and the chair concerned on which the calf-supporting part is to be fitted.

A comparison of FIGS. 9, 10 and 11 shows that the sheet-shaped supporting/carrying device 6 follows a curved path when being pushed between its retracted position and its protruding calf-supporting position, a fact which is also shown here in full and broken lines respectively.

Figure 13:
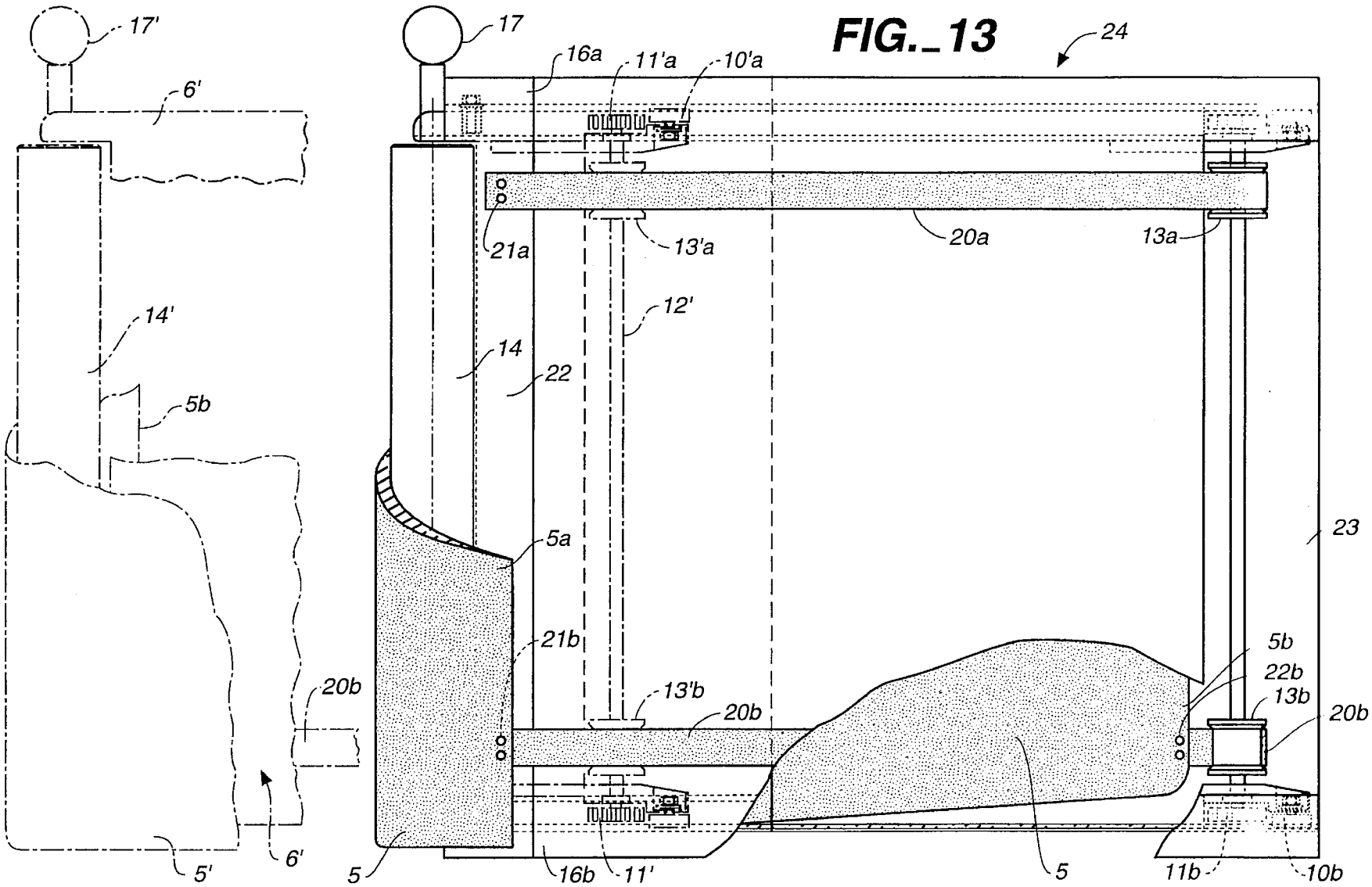
FIG. 13 is an outline, similar to FIG. 8, with further components of the calf-support included in the drawing.
Figure 14:
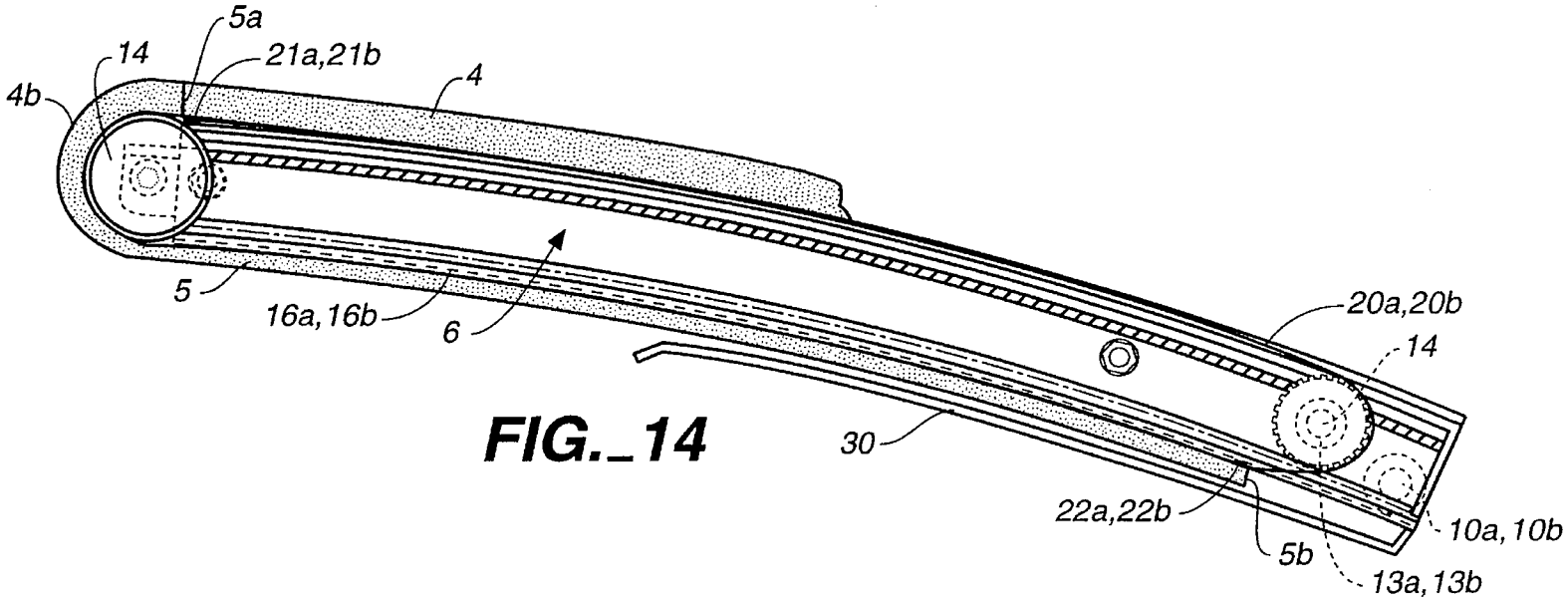
FIG. 14 shows a sideways outline of the embodiment according to FIG. 10, here with an adapted cut-out of the chair seat part and the contacting web-shaped portion of the calf-supporting part in its retracted position.
Figure 15:
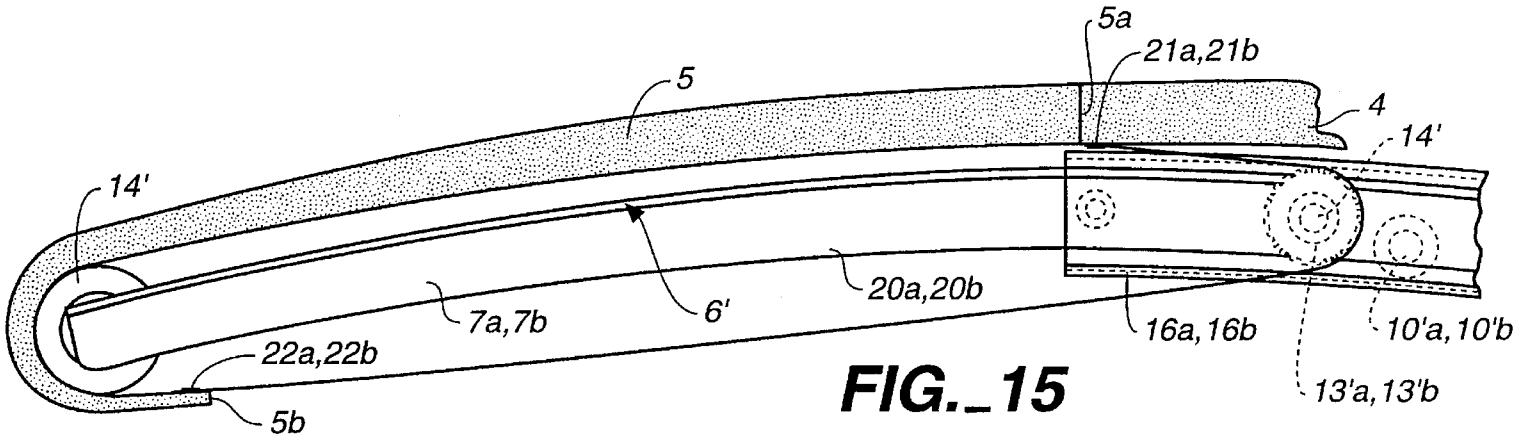
FIG. 15 shows a corresponding sideways outline as FIG. 14, but with the calf-supporting part and the web-shaped portion in its protruding calf-supporting position.

Shown in FIGS. 13–15 are two band-like guiding devices, 20a and 20b, respectively, which at one end, 21a and 21b, respectively, are fastened to e.g. a stationary crossbar 22 between the two grooves 16a, 16b, and carried in parallel along the top of the sheet-shaped device 6 and each via its guide reel on the transverse main axle 12, the reels 13a and 13b, respectively, in order at their opposite ends, 22a and 22b, respectively, to be attached to the internal, moveable traverse edge 5b, please see FIG. 1, of the web-shaped portion 5.

The web-shaped portion 5 may in turn have its second forward traverse edge 5a fastened in the area of the said stationary crossbar 22, or be otherwise attached in order chiefly to be flush with the chair seat part 4.

It should be understood that the said grooves 16a, 16b at their rear edges may be held together by means of a second crossbar 23, which entails that the sheet-shaped supporting/carrying device 6 with its pertaining grooves 16a, 16b, may be designed as a one-part bracket-frame, defined here by the reference numeral 24, which may be adapted to factory fitting or subsequent fitting on the chair concerned.

It should thus be understood that when the calf-support, comprising the web-shaped portion 5, is pushed forward from the position shown in FIG. 1 to the position shown in FIG. 2, this movement takes place in the embodiment mentioned above, in particular by means of the knob 18, and the transfer of force then takes place through the smooth sliding roller 14 which communicates directly with the underside of the web-shaped portion 5 to push it forward, while at the same time ever larger zones or proportions of the sheet-shaped supporting/carrying device 6 will support the said web-shaped portion 5. When the foot-rest 5 is pushed backwards, the knob 18 will be forced backwards, the force then being transferred to the sheet-shaped supporting/carrying device 6, while at the same time the parallel guide bands 20a, 20b, pull the rear moveable traverse edge 5b of the web-shaped portion 5 backwards to its shielded, inactive position under the chair seat part, while at the same time the said guide bands 20a, 20b, optionally by means of suitable additional devices, keep the said tranverse edge 5b and the web-shaped portion 5 as such well concealed underneath the chair seat part 4.

Such retaining devices are shown in FIG. 14 by the reference numeral 30 and may e.g. comprise a spring-loaded board or a multitude of springy fingers which with a rear portion are fixed to a corresponding rear portion of the supporting/carrying device 6 or a .rear portion of the said bracket-frame 24.

In order further to achieve a tight guiding of the band-like guiding devices 20a and 20b, these may be executed with suitable elasticity, and/or tracks or indentations (not shown) may be fashioned in the actual surface of the sheet-shaped device 6, in order that the bands 20a and 20b may be given a run as straight and taught as possible along the grooves.

It shall furthermore be understood that in the grooves 16a, 16b placed along the sides of the bracket-frame 24, straps (not shown) may be arranged which serve to guide the device 6 and determine how far the sheet-shaped device 6 can be pulled out of the bracket-frame 24 in its fully protruding position.

The device according to the invention is here described in connection with a chair, in particular a reclining rest for a chair, but it shall be understood that the device may also be used in general in furniture and in seating and resting bases for users of different sizes and different seating/resting needs.

We claim:

1. An arrangement for supporting a calf for a chair comprising a chair seat part and a back part, the calf-supporting arrangement comprising: a chiefly non-stiffened web-shaped portion which is supported by a moveable supporting/carrying device and which runs in a loop via at least one curved guide device attached to the moveable supporting/carrying device so that the web-shaped portion is continuously moveable between a shielded, inactive retracted position underneath the chair seat part and an active protruded calf-supporting position, chiefly flush with the chair seat part, the moveable supporting/carrying device further including a sheet-shaped supporting/carrying carriage arranged to support said chiefly non-stiffened web-shaped portion.

2. An arrangement according to claim 1, wherein the non-stiffened web-shaped portion is a cover material chiefly separate from a cover material of the chair.

3. An arrangement according to claim 2, wherein each side of a rear portion of said sheet shaped supporting/carrying carriage is fitted with a smooth wheel and a toothed wheel.

4. An arrangement according to claim 3, wherein each toothed wheel of the sheet-shaped supporting/carrying carriage interacts with a respective toothed tracking/guiding device in a groove placed at the sides and fastened to at least one of an underside of the chair seat part; and to other parts of the chair.

5. An arrangement according to claim 4, wherein each wheel of the sheet-shaped supporting/carrying carriage runs in the groove along a groove portion which is opposite to a groove portion.

6. An arrangement according to claim 4, wherein each smooth wheel of the sheet-shaped supporting/carrying carriage runs in a groove along a groove portion which is opposite to a groove portion which carries said respective toothed tracking/guiding device.

7. An arrangement according to claim 1, wherein each side of a rear portion of said sheet shaped supporting/carrying carriage includes a smooth wheel and a toothed wheel.

8. An arrangement according to claim 7, wherein each toothed wheel of the sheet-shaped supporting/carrying carriage interacts with a respective toothed tracking/guiding device arranged in a groove placed at the sides and fastened to at least one of an underside of the chair seat part, and to other parts of the chair.

9. An arrangement according to claim 8, wherein each smooth wheel of the sheet-shaped supporting/carrying carriage runs in the groove along a groove portion which is opposite to a groove portion which carries said respective toothed tracking/guiding device.

10. An arrangement according to claim 9, wherein a forward portion of said sheet shaped supporting/carrying carriage carries said guide device as a freely rotatable chiefly smooth sliding roller running in a transverse direction.

11. An arrangement according to claim 1, wherein a forward portion of said sheet shaped supporting/carrying carriage carries a guide device fashioned as a freely rotatable chiefly smooth sliding roller running in a transverse direction.

12. An arrangement according to claim 11, wherein at a rear area of the sheet shaped supporting/carrying carriage, a transversely running rotating axle is arranged carrying toothed wheels in order thereby to rotate in step with these toothed wheels, and that, around said transversely running rotating axle, at least one band-like guiding device has been wound.

13. An arrangement according to claim 1, wherein at a rear area of the sheet shaped supporting/carrying carriage, a transversely running rotating axle is arranged carrying toothed wheels in order thereby to rotate in step with these toothed wheels, and that, around said transversely running rotating axle, at least one band-like guiding device has been wound.

14. An arrangement according to claim 13, wherein the band-like guiding device is adapted to be fixed at one end permanently at a frame portion chiefly arranged at a lower forward area of the chair seat part, in which area also one stationary transverse edge of the web-shaped portion is adapted to be attached, the guiding device being at a second end attached to an opposite movable traverse edge of the web-shaped portion.

15. An arrangement according to claim 14, wherein two parallel bands are arranged guiding devices wherein each of said parallel bands is carried between traverse edges of the web-shaped portion and, via an associated guide reel, is arranged on the rotating axle.

16. An arrangement according to claim 13, wherein two parallel bands are arranged as guiding devices wherein each of said two parallel bands is carried between transverse edges of the web shaped portion and an associated guide reel, is arranged on the said rotating axle.

17. An arrangement according to claim 16, wherein the sheet-shaped supporting/carrying carriage with pertaining grooves a one-part bracket-frame adapted for fitting on a chair.

18. An arrangement according to claim 1, wherein the sheet-shaped supporting/carrying carriage is a one-part bracket-frame adapted for fitting on a chair.

19. An arrangement according to claim 18, wherein the sheet-shaped supporting/carrying carriage is fashioned as a slightly curved sheet, said curved sheet being arranged for being fitted slidingly into corresponding curved grooves, said sheet-shaped supporting/carrying carriage being adapted to the chair on which the calf supporting arrangement is to be fitted.

20. An arrangement according to claim 1, wherein said sheet-shaped supporting/carrying carriage is fashioned as a slightly curved sheet, said curved sheet being arranged for being fitted slidingly into corresponding curved grooves, said sheet-shaped supporting/carrying carriage being adapted to the chair on which the calf supporting arrangement is to be fitted.

21. An arrangement according to claim 20, further comprising at least one retaining device which keeps a rear transverse edge of the web-shaped portion underneath the chair seat part when the web-shaped portion is retracted beneath the chair seat part.

22. An arrangement according to claim 1, further comprising at least one retaining device which keeps a rear transverse edge of the web-shaped portion underneath the chair seat part when the web-shaped portion is retracted beneath the chair seat part.

23. An arrangement according to claim 22, wherein the at least one retaining device is selected from a spring loaded board and multiple springy fingers, each having a rear portion and a protruding front portion, the at least one retaining device having a rear portion which is fixed to at least one of a corresponding rear portion of the supporting/carrying device, and a rear portion of a bracket-frame, and with a protruding portion of said supporting/carrying device forming a guide and a support for the web-shaped portion.

* * * * *